US007182139B2

(12) United States Patent
Rayssiguier et al.

(10) Patent No.: US 7,182,139 B2
(45) Date of Patent: Feb. 27, 2007

(54) SYSTEM AND METHOD FOR CONTROLLING DOWNHOLE TOOLS

(75) Inventors: Christophe M. Rayssiguier, Melun (FR); Jason K. Jonas, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 214 days.

(21) Appl. No.: 10/659,929

(22) Filed: Sep. 11, 2003

(65) Prior Publication Data

US 2004/0050555 A1 Mar. 18, 2004

Related U.S. Application Data

(60) Provisional application No. 60/410,388, filed on Sep. 13, 2002.

(51) Int. Cl.
*E21B 34/10* (2006.01)

(52) U.S. Cl. ..... 166/374; 166/72; 166/386

(58) Field of Classification Search ..... 166/72, 166/375, 319, 373, 374, 386
See application file for complete search history.

(56) References Cited

U.S. PATENT DOCUMENTS

| | | | | |
|---|---|---|---|---|
| 3,993,100 | A | 11/1976 | Pollard et al. | |
| 4,185,652 | A * | 1/1980 | Zintz et al. | 137/78.2 |
| 4,308,884 | A | 1/1982 | Hoerger et al. | |
| 4,407,183 | A | 10/1983 | Milberger et al. | |
| 4,442,902 | A | 4/1984 | Doremus et al. | |
| 4,467,833 | A | 8/1984 | Satterwhite et al. | |
| 4,497,369 | A | 2/1985 | Hurta et al. | |
| 4,945,995 | A | 8/1990 | Tholance et al. | |
| 5,048,293 | A * | 9/1991 | Aoyagi | 60/420 |
| 5,054,369 | A | 10/1991 | Wardle et al. | |
| 6,012,518 | A | 1/2000 | Pringle et al. | |
| 6,173,772 | B1 | 1/2001 | Vaynshteyn | |
| 6,179,052 | B1 | 1/2001 | Purkis et al. | |
| 6,182,750 | B1 | 2/2001 | Edwards et al. | |
| 6,213,203 | B1 | 4/2001 | Edwards et al. | |
| 6,244,351 | B1 | 6/2001 | Patel et al. | |
| 6,247,536 | B1 | 6/2001 | Leismer et al. | |
| 6,354,374 | B1 | 3/2002 | Edwards et al. | |
| 6,513,589 | B1 | 2/2003 | Hansen et al. | |
| 6,536,530 | B2 | 3/2003 | Schultz et al. | |
| 6,543,544 | B2 | 4/2003 | Schultz et al. | |
| 6,567,013 | B1 | 5/2003 | Purkis et al. | |
| 6,575,237 | B2 | 6/2003 | Purkis et al. | |
| 2002/0053438 | A1 | 5/2002 | Williamson, Jr. | |
| 2002/0066574 | A1 | 6/2002 | Leismer et al. | |

FOREIGN PATENT DOCUMENTS

| | | | |
|---|---|---|---|
| GB | 2335216 | A | 9/1999 |
| WO | WO 99/47788 | A1 | 9/1999 |
| WO | WO 00/04273 | A1 | 1/2000 |
| WO | WO00/09855 | A1 | 2/2000 |
| WO | WO01/63089 | A1 | 8/2001 |

* cited by examiner

*Primary Examiner*—Kenneth Thompson
(74) *Attorney, Agent, or Firm*—Van Someren, PC; Bryan P. Galloway; Jaime A. Castano

(57) ABSTRACT

A system and method is provided for integrated control of multiple well tools. Predetermined pressure levels are utilized in independently actuating specific well tools from a plurality of well tools. The number of well tools independently controlled may be greater than the number of fluid control lines that cooperate with the well tools to control tool actuation.

34 Claims, 10 Drawing Sheets

SYSTEM AND METHOD FOR CONTROLLING DOWNHOLE TOOLS

CROSS-REFERENCE TO RELATED APPLICATIONS

The following is based on and claims priority to Provisional Application Ser. No. 60/410,388, filed Sep. 13, 2002.

BACKGROUND

In a variety of subterranean environments, such as wellbore environments, downhole tools are used in many applications. For example, downhole tools may comprise safety valves, flow controllers, packers, gas lift valves, sliding sleeves and other tools. In many applications, the downhole tools are hydraulically controlled via hydraulic control lines. For example, a dedicated hydraulic control line may be run downhole to an individual tool. However, the number of tools placed downhole can be limited by the number of control lines available in a given wellbore. Often, the maximum number of hydraulic control lines is between two and four lines. The space constraints of the wellbore or wellbore equipment, e.g. packers, located within the wellbore also can limit the number of control lines. Even if additional control lines can be added, the additional lines tend to slow the installation and increase the cost of installing equipment downhole.

Attempts have been made to reduce or eliminate the use of hydraulic control lines through, for example, the use of multiplexers, electric/solenoid controlled valves or custom-designed hydraulic devices and tools that respond to sequences of pressure pulses. Such designs, however, have proved to be relatively slow and/or expensive. Also, in the case of custom-designed hydraulic devices and tools, two control lines can only be used to control a maximum of two tools.

SUMMARY

In general, the present invention provides a simplified, integrated control system and methodology for controlling multiple downhole tools. The system and method enable the control of a much greater number of tools with fewer fluid control lines. Each of the tools is independently controllable by applying pressure, within at least one of the control lines, that falls within a pressure range uniquely associated with the activation of a specific device.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for controlling downhole tools. The system and method are useful with, for example, a variety of downhole completions and other production equipment. However, the devices and methods of the present invention are not limited to use in the specific applications that are described herein to enhance the understanding of the reader.

Figure 1:
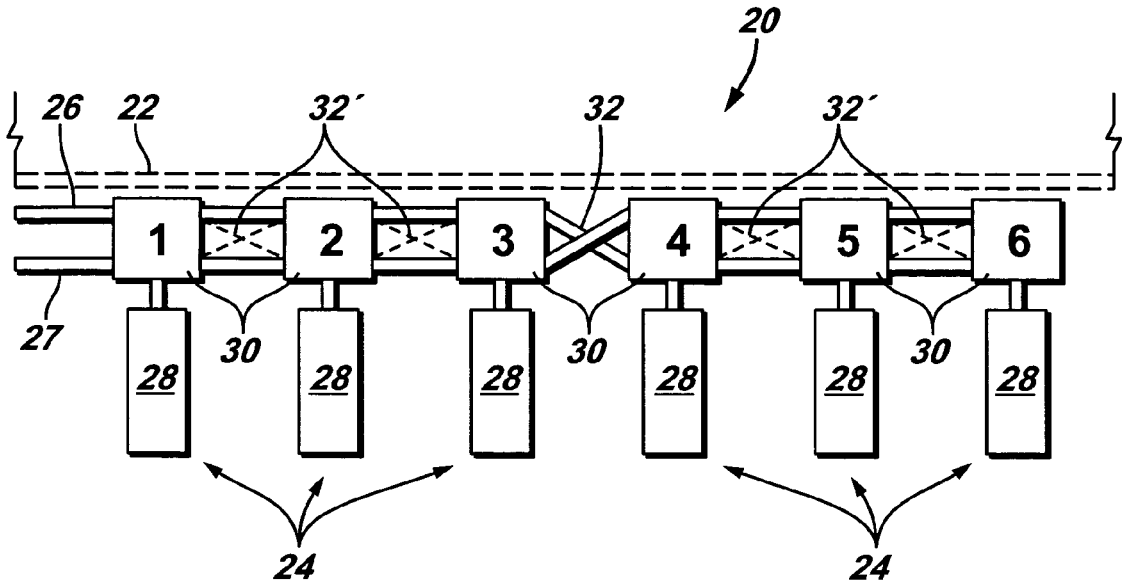
FIG. 1 is a schematic illustration of a system of downhole tools, according to an embodiment of the present invention.

Referring generally to FIG. 1, a system 20 is illustrated according to an embodiment of the present invention. The system 20 may be mounted along or otherwise coupled to equipment 22 used in a subterranean environment. Equipment 22 comprises, for example, a downhole completion or other equipment utilized in a wellbore environment, such as an oil or gas well.

In the embodiment illustrated, system 20 has a plurality of well tool devices 24. The actuation of well tool devices 24 may be controlled via a plurality of control lines, e.g. control lines 26 and 27. In many applications, control lines 26, 27 extend from a location at the surface of the earth or at the seabed. The number of well tool devices 24 that can be independently controlled via the control lines is substantially greater than the number of control lines. For example, two control lines 26,27, as illustrated in FIG. 1, can be used to control a plurality of well tool devices, e.g. three or more well tool devices 24. In the specific embodiment illustrated, the two control lines are used to independently control six well tool devices 24, i.e. three times as many well tool devices as control lines.

In the illustrated example, each well tool device 24 comprises a well tool 28 that may be fluidically actuated. For example, each well tool 28 may be actuated via a hydraulic fluid flowing through one of the control lines 26, 27. The plurality of well tools 28 may comprise a variety of tool types and combinations of tools depending on the application. For example, the well tools 28 may comprise valves, such as downhole valves or safety valves, flow controllers, packers, gas lift valves, sliding sleeves and other tools that may be actuated by a fluid, e.g. a hydraulic fluid. Although each well tool device is illustrated as comprising a single well tool, the well tool devices may each comprise a plurality of separately controlled well tool components.

Each well tool device 24 also comprises a decoder 30, such as a hydraulic downhole decoder unit. The control lines 26,27 are connected to each of the decoders 30, and the decoders 30 control fluid flow to each well tool 28 for selective actuation of specific well tools based on fluid inputs through at least one of the control lines 26 and 27. The same type or style of decoder 30 may be used with each well tool 28 to simplify repair, servicing and replacement of the decoder unit. However, one difference between decoder units is the type of spring members that are utilized to enable actuation of the decoder (and thus actuation of a specific tool 28) based on unique pressure levels applied to the decoders.

As addressed in greater detail below with reference to specific examples of decoder units, each specific decoder 30 and the well tool 28 associated with that specific decoder are actuated by applying a pressure through one of the control lines 26 and 27 that falls within a predetermined pressure range. For example, in the embodiment illustrated in FIG. 1, control line 26 serves as a pilot line for the decoders 30 labeled 1, 2 and 3. Each of those decoders is actuated when pressure within control line 26 falls within a unique, predetermined range. For example, three finite pressure ranges may be established within the overall pressure range from 0 pounds per square inch (psi) to 10,000 psi or 12,500 psi. When the pressure in control line 26 falls within one of the three finite pressure ranges associated with one of the three decoders 30, that specific decoder is actuated. The actuated decoder enables flow of pressurized fluid from control line 27 to the specific well tool 28 coupled to the actuated decoder 30, thereby enabling actuation of the desired well tool 28 at any pressure in as many times as desired. Depending on the application, however, a greater number of finite pressure ranges may be established to enable independent control of more than three well tools 28. On the contrary, the number of finite pressure ranges may be limited to one or two to simplify the operation and to reduce costs when controlling a smaller number of well tools or when adding one or more additional control lines.

Also, a greater number of well tools 28 may be independently controlled by utilizing one or more crossovers 32. As illustrated in FIG. 1, crossover 32 effectively crosses control lines 26 and 27 such that control line 27 acts as the pilot line for the decoders 30 labeled 4, 5 and 6. Control line 26 thus acts as the command line for these three decoders. By establishing a unique, predetermined pressure level within control line 27, any one of the decoders labeled 4, 5 or 6 can be actuated to enable pressurized flow from control line 26 to the desired well tool 28. Alternatively, crossovers 32', shown in dashed lines, can be deployed between each sequential decoder 30 to achieve the same result while minimizing the risk of human error during installation. With either embodiment, two control lines can be utilized to independently control six well tool devices 24. If additional unique, predetermined pressure levels are established, an even greater number of well tool devices 24 can be controlled by two control lines.

Figure 2:
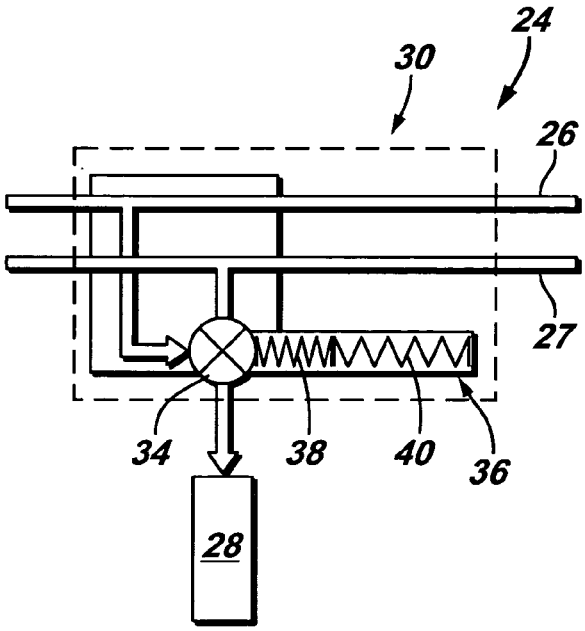
FIG. 2 is a schematic illustration of an embodiment of a decoder that may be used with the system illustrated in FIG. 1.

A variety of decoders 30 can be utilized to respond to specific pressure level ranges within a pilot control line. A basic example is illustrated in FIG. 2. For the purposes of explanation, control line 26 is utilized as the pilot line, and control line 27 is utilized as the command line in this example. Decoder unit 30 comprises a main valve disposed between command line 27 and well tool 28. When main valve 34 is closed, no fluid flows from command line 27 to well tool 28, leaving the well tool unactuated. However, when main valve 34 is opened, pressurized fluid from command line 27 flows to well tool 28 to actuate the tool.

Figure 3:
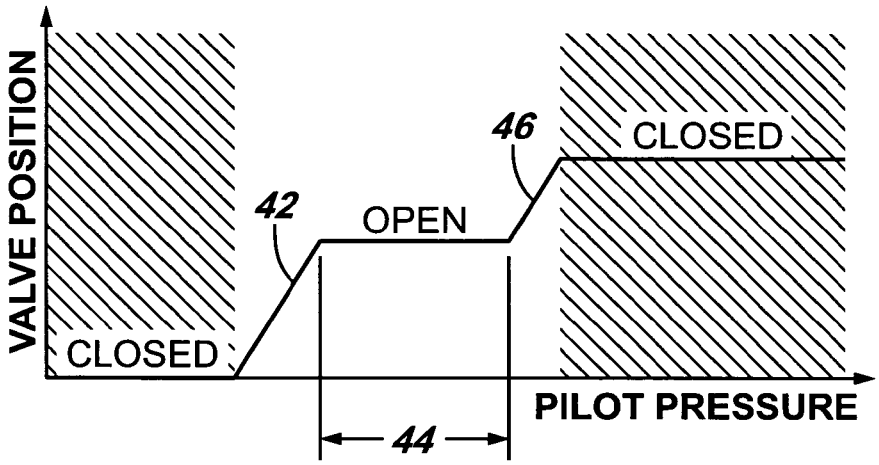
FIG. 3 is a diagram illustrating an example of a unique pressure range through which the decoder enables actuation of a specific downhole tool.

The opening of main valve 34 is controlled by pressure in pilot line 26 and a counteracting biasing member 36, such as a spring assembly. In this embodiment, biasing member 36 comprises a pair of springs 38 and 40, such as coil springs. Spring 38 is a weaker spring in the sense that it exerts a lower spring force compared to spring 40. Spring 38 is disposed between spring 40 and main valve 34. When pressure is applied to main valve 34 in a direction opposed to the bias of springs 38 and 40, main valve 34 remains closed until the pressure in pilot line 26 is sufficient to overcome the force of spring 38. At this point, main valve 34 begins to open, as further illustrated by transition 42 in FIG. 3. When the pressure in pilot line 26 reaches the unique, predetermined pressure range 44, main valve 34 remains open throughout this operating range, and well tool 28 can be actuated by applying pressure through command line 27. If the pressure level within pilot line 26 is increased beyond the unique, predetermined pressure range 44, the biasing force of spring 40 is overcome and main valve 34 transitions (see transition 46) to a closed position preventing flow of fluid to well tool 28 from command line 27. For each decoder 30, biasing member 36, e.g. springs 38 and 40, is selected to enable opening of main valve 34 over a unique, defined and predetermined range of pressure within pilot line 26. The predetermined pressure range can be changed and adjusted simply by changing the biasing member 36 in a given decoder 30.

Figure 4:
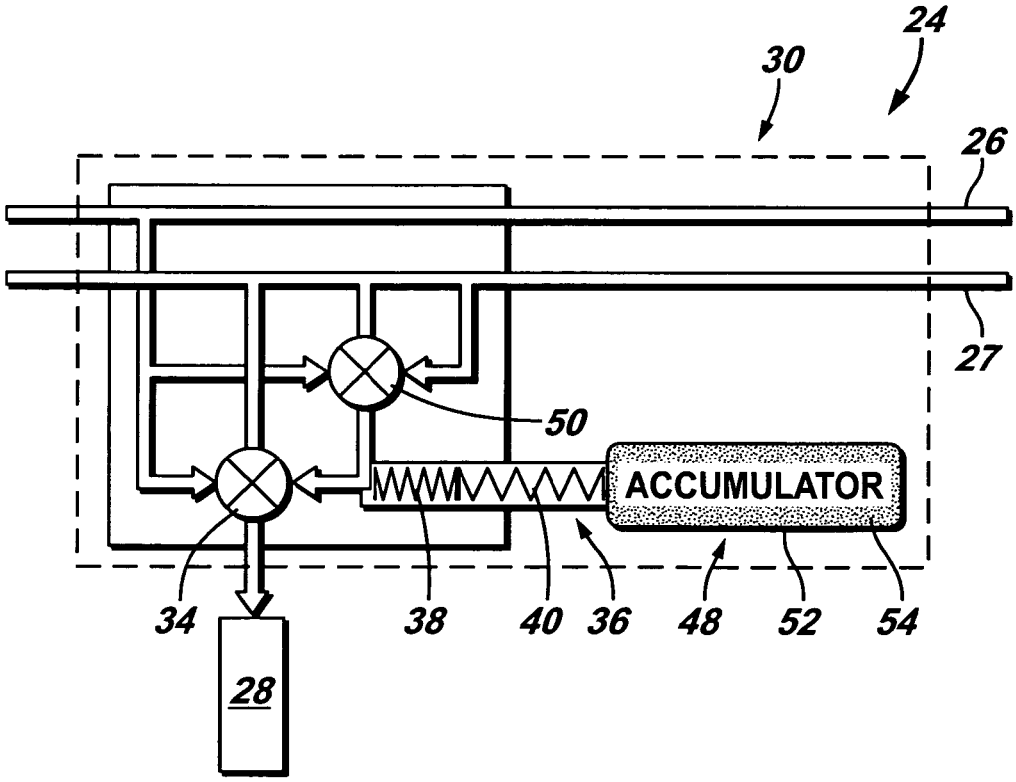
FIG. 4 is an illustration of an alternate embodiment of the decoder illustrated in FIG. 2 in which a decoder is insensitive to hydrostatic pressure due to use of a reference pressure trapped in a hydraulic accumulator.

In another embodiment of decoder 30 illustrated in FIG. 4, an accumulator 48 and an accumulator valve 50 are added to decoder 30. The accumulator 48 creates a reference pressure within a closed chamber 52 to act against main valve 34.

Accumulator valve 50 is normally open when control lines 26 and 27 are at the same pressure. Specifically, the accumulator 48 is open to command line 27 and is pressurized by the hydrostatic head of the control fluid during deployment downhole. If the pressure in pilot line 26 exceeds the pressure in command line 27 by a given value (the value is typically low, e.g. a few hundred pounds per square inch), the accumulator valve 50 closes and isolates the accumulator to create a reference pressure at the back side of main valve 34. The reference pressure does not vary with well pressure or pressure within control line 27.

The valve 50 illustrated in FIG. 4 also may have a self maintaining feature in that once the accumulator valve is closed, a reverse differential pressure cannot reopen it. This feature can be obtained by using different piston areas on the sides of the accumulator valve. Also, when main valve 34 is operated, the accumulator volume may vary slightly and increase the reference pressure. To reduce the pressure change, a material 54 having a high compressibility factor can be disposed in closed chamber 52. Material 54 may be a solid, such as a plastic or silicon, a gel, a liquid or a gas contained by a membrane.

Figure 5:
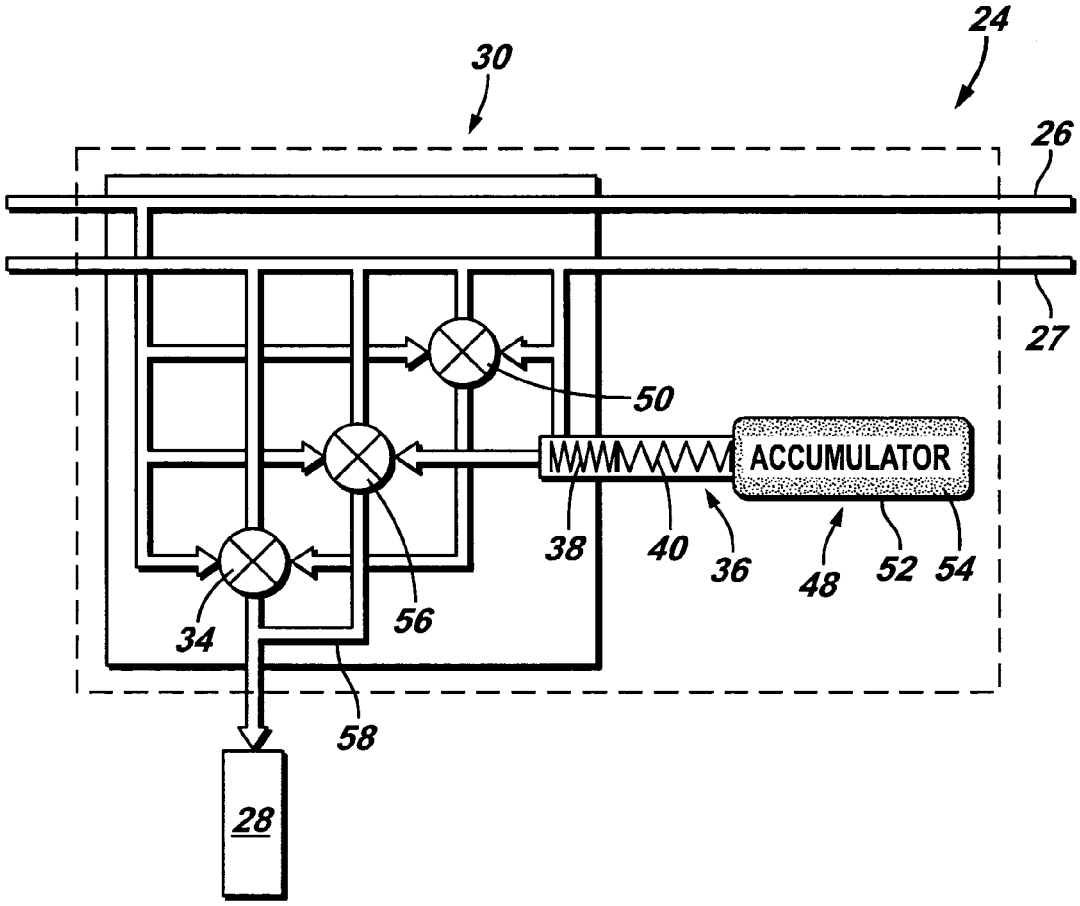
FIG. 5 is an illustration of an alternate embodiment of the decoder illustrated in FIG. 4 in which a bypass valve is used to equalize all pressures in the absence of a signal.

In FIG. 5, another embodiment of decoder 30 is illustrated. In this embodiment, a filling valve 56 is disposed in parallel with main valve 34 to open a communication port 58 between the command line 27 and the tool 28. Filling valve 56 is normally open to enable communication between the inside of tool 28 and command line 27 during installation when no pressure is applied to control lines 26 or 27. By opening the communication line, atmospheric pressure that would otherwise be trapped in tool 28 is allowed to equalize with the hydrostatic pressure of command line 27. Also, if the fluid within the system tends to expand due to increased temperature, the fluid can flow through the command line 27 and effectively vent to the surface or other suitable location. As soon as the differential pressure between control lines 26 and 27 exceeds a certain threshold, the filling valve 56 closes. This threshold typically is set at a pressure sufficiently low such that tool 28 is not actuated by the low pressure.

Figure 6:
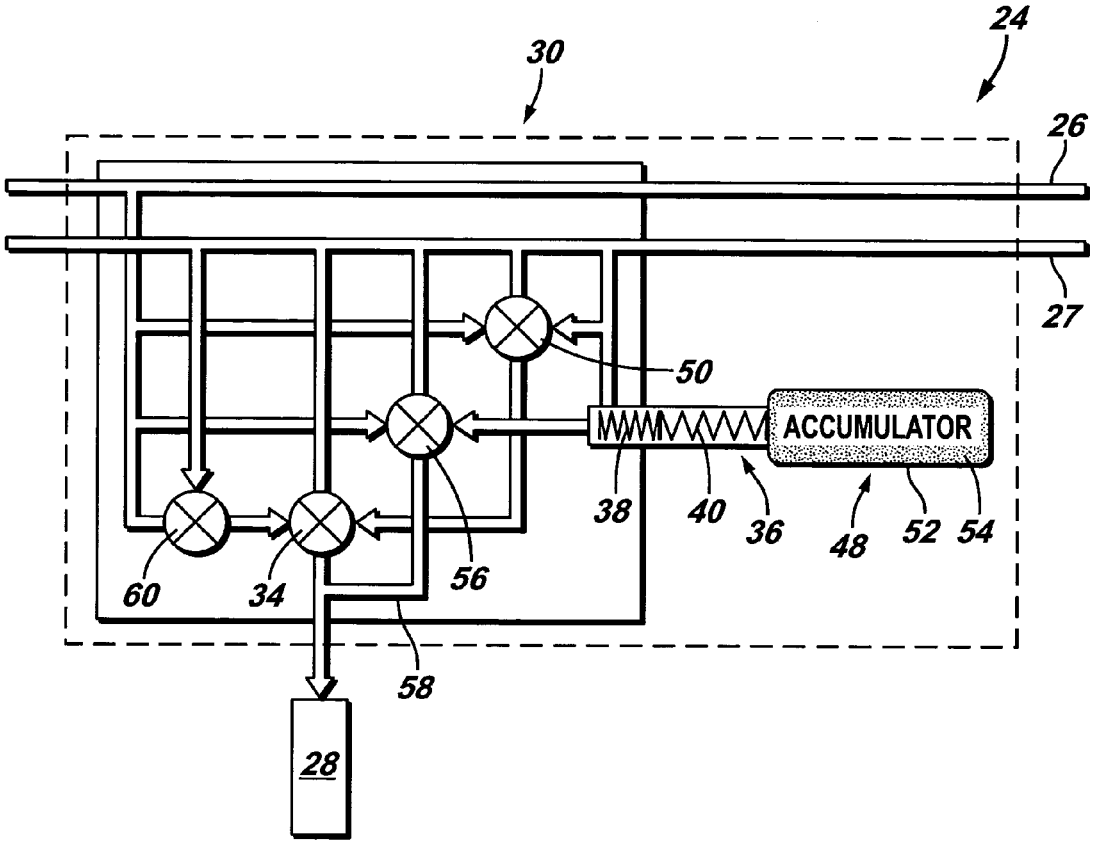
FIG. 6 is an illustration of an alternate embodiment of the decoder illustrated in FIG. 5 in which a valve locks the decoder whenever the second line is pressurized first.

Another embodiment of decoder 30 is illustrated in FIG. 6. In this embodiment, a pilot valve 60 is placed between the control line acting as the pilot line, e.g. control line 26, and the main valve 34. The use of pilot valve 60 facilitates increasing, e.g. doubling, of the number of well tools 28 that may be independently controlled for the same predetermined pressure ranges and the same number of control lines.

The embodiment illustrated in FIG. 6 works well if a single crossover 32 or multiple crossovers 32, 32' are used. When the control lines are crossed between decoders, each control line 26, 27 serves as both a pilot line and a command line. For example, control line 26 may serve as the pilot line for a first group of well tool devices 24 and as the command line for a second group of well tool devices 24 when a single crossover is used. Or, control line 26 can serve as the pilot line for every other well tool device 24 and as the command line for the intermediate well tool devices 24 when crossovers are used between each well tool device. Regardless, control line 26 can be used as a pilot line for 50 percent of the well tool devices 24 and as a command line for the others. Control line 27, of course, serves as the pilot line and command line for the opposite well tool devices relative to control line 26.

Pilot valve 60 is used to close the control line acting as command line for certain valves if pressurized before the pilot line for those valves. If the pressure in command line 27 exceeds the pressure in pilot line 26 by a given threshold, the pilot valve 60 closes and isolates the main valve 34. Additionally, pilot valve 60 can be self-maintained in the closed position to ensure the valve remains closed regardless of the pressure applied in the pilot line after pilot valve closure. The self-maintained functionality can be obtained, for example, by utilizing appropriately selected surface areas, as described above with respect to accumulator valve 50.

The various decoders 30 discussed above can be packaged in a variety of ways. For example, the various valves may be independent valves coupled by hydraulic lines, or the various valves and flow lines can be formed in a single manifold. Additionally, the various valves, springs and seals can be positioned in a variety of arrangements depending on the desired shape, size and functionality of the decoder. In a specific example illustrated in FIGS. 7 through 10, the various valves and flow paths are cut in a single, solid piece manifold to reduce the potential for leaks.

Figure 7:
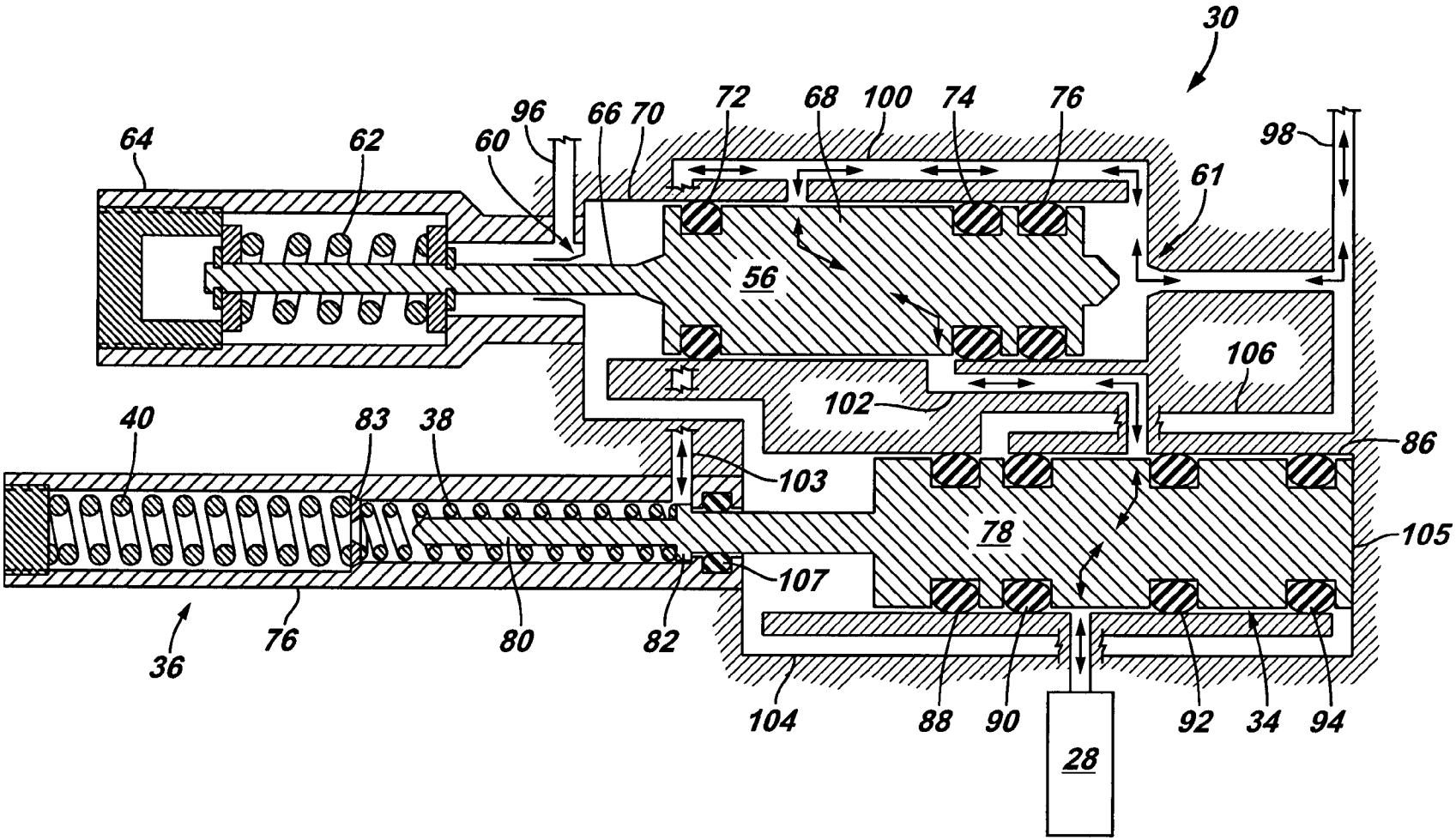
FIG. 7 is a cross-sectional view of an embodiment of a valve system that can be used to control actuation of a downhole tool, according to an embodiment of the present invention.

As illustrated in FIG. 7, the pilot valve 60, filling valve 56 and a command valve 61 are packaged together and acted on by a single spring 62. Spring 62 is contained within a spring chamber 64 and coupled to a rod 66 which, in turn, is connected to a spool 68 slidably mounted in a spool chamber 70. A plurality of seals, e.g. seals 72, 74 and 76, are disposed about spool 68. The seals may be O-ring style seals that form a seal between spool 68 and the wall forming spool chamber 70. Other seal assemblies also may be used, such as redundant plastic seals with or without metal springs to energize each seal element.

In this embodiment, springs 38 and 40 may be designed as a removable spring cartridge. Springs 38 and 40 are disposed within a main valve spring chamber 76 and operatively coupled to a main valve spool 78 of main valve 34. Main valve spool 78 may be operatively coupled to springs 38 and 40 by a rod 80 that connects to main valve spool 78 and extends into the interior of spring 38, e.g. a coil spring. A flange 82 acts against spring 38 and compresses spring 38 towards spring 40. Thus, as main valve spool 78 moves to the left (as illustrated in FIGS. 7–10), spring 38 is initially compressed against a slidable stop 83 that separates spring 38 and spring 40. Upon sufficient movement of main valve spool 78 toward spring 40, rod 80 abuts stop 83 and begins to compress spring 40.

As illustrated, main valve spool 78 is slidably mounted in a main valve chamber 86. A plurality of main valve seals, e.g. main valve seals 88, 90, 92 and 94, are disposed about main valve spool 78 to form a seal between main valve spool 78 and the wall of main valve chamber 86.

In FIG. 7, decoder 30 is illustrated in a neutral position with virtually no differential pressure between a pilot line 96 and a command line 98. In this position, both pilot valve 60 and command valve 61 are open, and fluid, such as hydraulic fluid, can flow from command line 98, through command valve 61, through a flow line 100, across filling valve 56, through a connecting flow line 102, across main valve spool 78 of main valve 34 and to the tool 28. Other flow lines, such as flow line 103 may be used to enable equalization of pressures within various tool or decoder chambers. The neutral position may be maintained, for instance, during installation of the system into a wellbore to enable equalization of pressure between the interior of tool 28 and command line 98. The neutral position may be maintained at any time between tool actuations so that the hydraulic fluid can vent to the surface whenever it tends to expand due to increased temperature.

Figure 8:
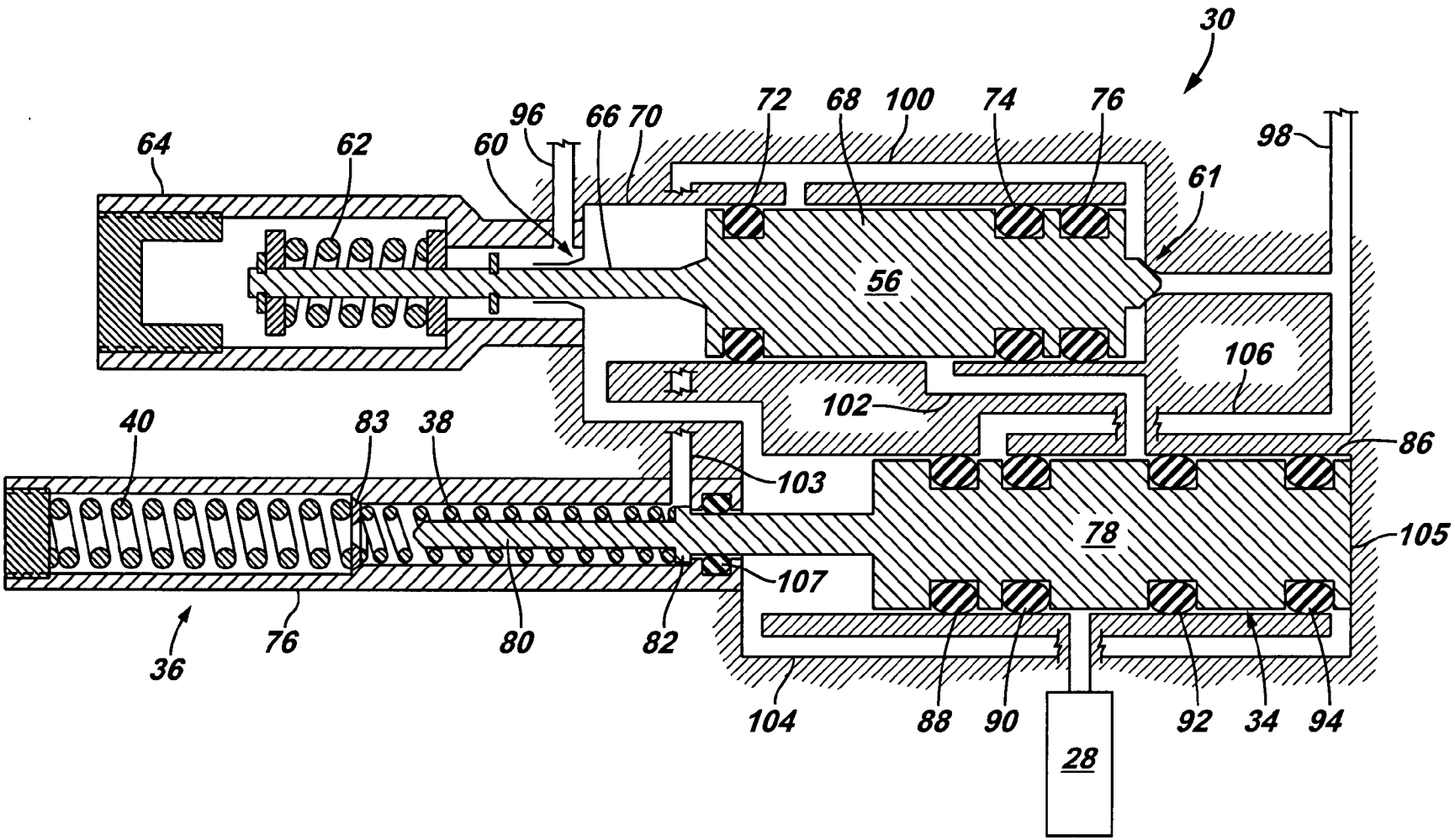
FIG. 8 is a view similar to that of FIG. 7 but showing the valve system in an isolated position caused by an excessive pressure on the pilot line.

When pressure lower than the unique, predetermined pressure range associated with activation of the specific decoder 30 is applied to pilot line 96, spool 68 is moved along spool chamber 70 to close command valve 61, as illustrated best in FIG. 8. With the relatively low pressure applied to pilot line 96, there is no flow across filling valve 56, and springs 38 and 40 maintain main valve spool 78 in a position such that seal 90 prevents any flow to tool 28 from command line 98. Accordingly, tool 28 remains in an unactuated state.

Figure 9:
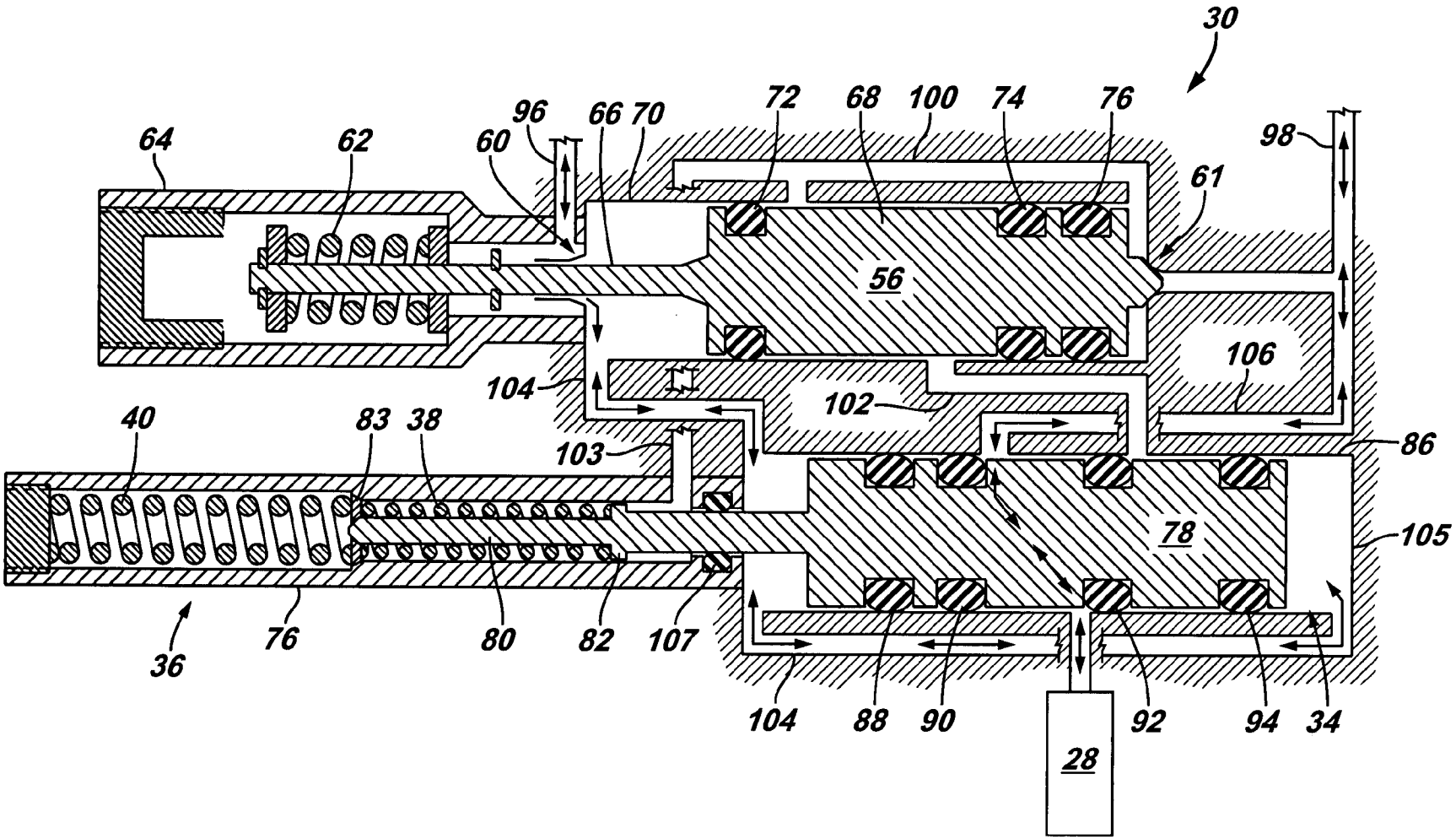
FIG. 9 is a view similar to that of FIG. 7, but showing the valve system in an operating position in which the tool is connected to the command line through the decoder for actuation as many times as desired.

If the pressure within pilot line 96 is increased to a level falling within the unique, predetermined pressure range associated with actuation of the specific decoder 30, main valve spool 78 is moved in a direction to compress spring 38, as illustrated best in FIG. 9. Specifically, fluid flows from pilot line 96 through pilot valve 60, along a flow path 104 and into main valve chamber 86 on a side 105 of main valve spool 78 generally opposite spring 38. The differential area between the surface area of spool side 105 and the surface area on the opposite spool side at shaft 80 is selected such that main valve spool 78 moves in a direction to compress spring 38 when the pressure in pilot line 96 falls within the unique, predetermined range associated with activation of decoder 30. In this configuration, fluid from command line 98 flows through a connector line 106, across main valve spool 78 between seals 90 and 92, and to tool 28 for tool actuation. A seal 107 may be disposed about shaft 80 between spool 78 and spring 38, as illustrated.

Figure 10:
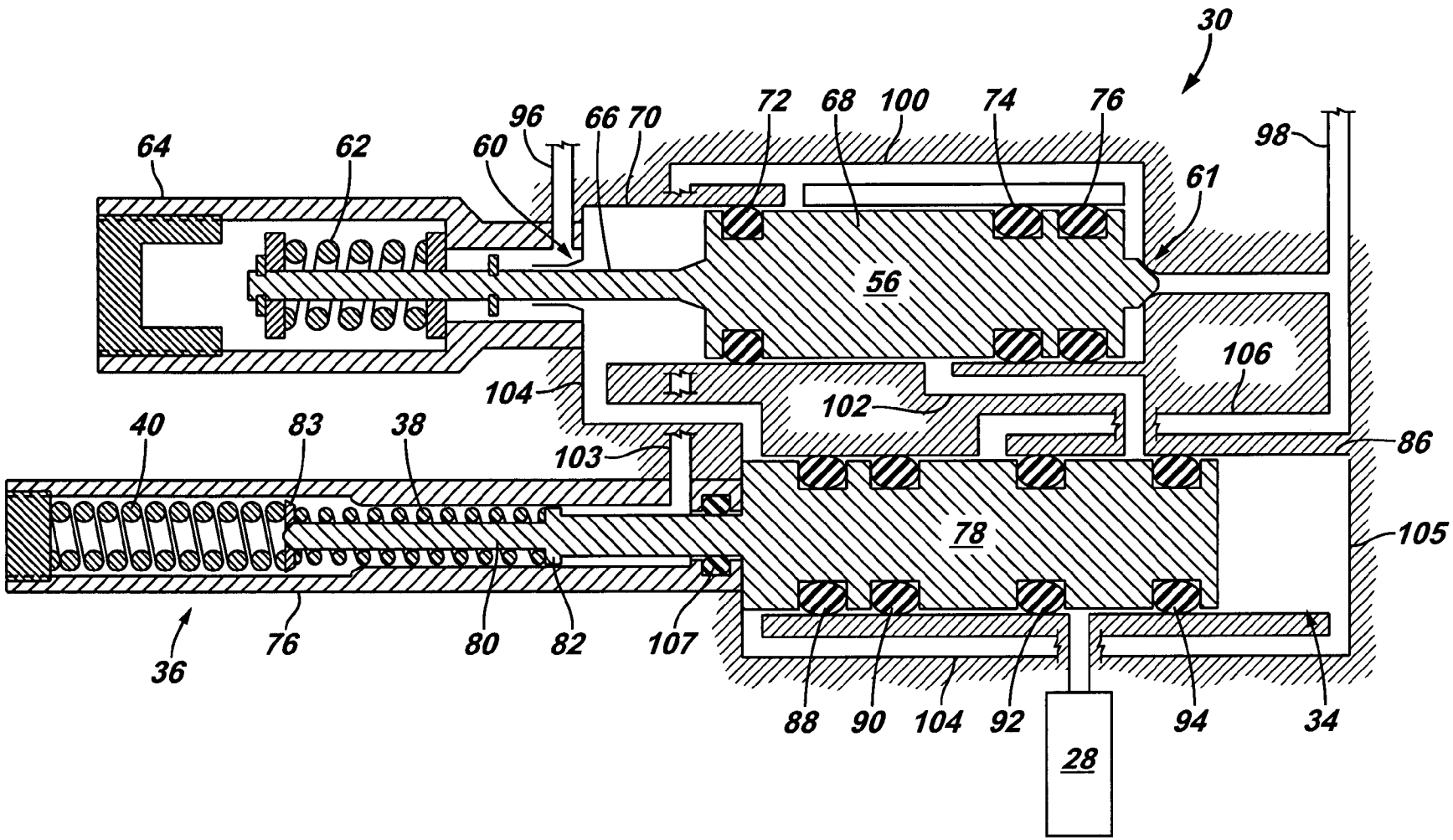
FIG. 10 is another view similar to that of FIG. 7, but showing the valve system in another isolated position when pressure in the pilot line is below a predetermined pressure range.

If, however, the pressure in pilot line 96 is increased beyond the unique, predetermined pressure range associated with actuation of decoder 30, main valve spool 78 is moved against the bias of spring 40 to interrupt flow between connector line 106 and tool 28, as illustrated best in FIG. 10. Specifically, the pressure in main valve chamber 86 is sufficient to overcome the spring bias of spring 40. Rod 80 is forced against stop 83 with sufficient force to compress spring 40 until spool 78 stops against the left wall of chamber 86. In that position, seal 92 blocks flow across main valve spool 78 from connector line 106 to tool 28. It also should be noted that if sufficient pressure is applied to command line 98 before pressurizing pilot line 96, spool 68 is moved to close pilot valve 60, effectively isolating tool 28 as the spool 78 cannot move any farther. This latter functionality enables the use of crossovers 32.

Figure 11:
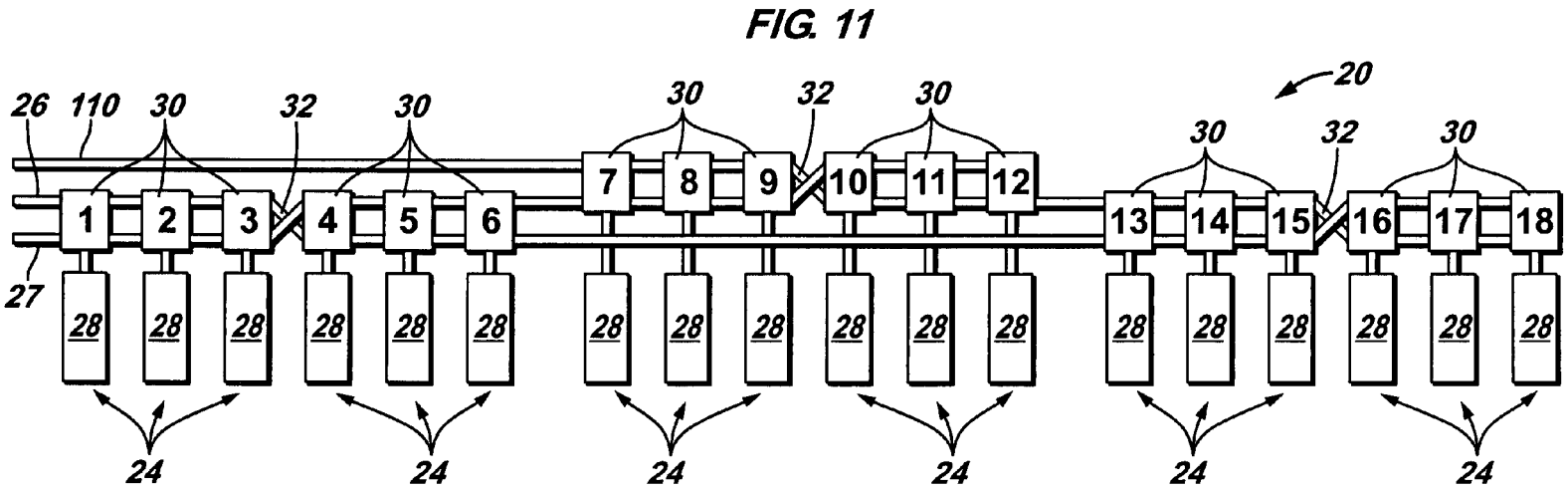
FIG. 11 is a schematic illustration of an alternate embodiment of the present invention in which three control lines are utilized to increase the number of independent tools controlled.

The general concept of utilizing a relatively small number of control lines to control a substantial number of downhole tools is applicable to the use of more than two control lines. As illustrated in FIG. 11, an additional control line 110 can be used to further increase the number of well tool devices 24 that are independently controlled. For example, if three unique, predetermined pressure ranges are utilized, the three control lines 26, 27 and 110 can readily be used to independently control nine well tool devices 24. If crossovers 32 are added, as illustrated in FIG. 11, eighteen well tool devices 24 can be independently controlled with three control lines. Of course, if additional unique, predetermined pressure ranges are used, an even greater number of well tool devices 24 can be controlled with three control lines. On the contrary, if no pressure adjustment is available at surface or at the seabed, the system can still control up to six independent tools via three control lines, as described below with reference to FIG. 14. In that case, all decoders 30 may be equipped with the same spring assembly. The spring assembly can be simplified by using a single spring, as it is only necessary to define one pressure threshold. If additional control lines are used, an even greater number of well tool devices 24 can be controlled with, for example, a single, unique, predetermined pressure range.

Figure 12:
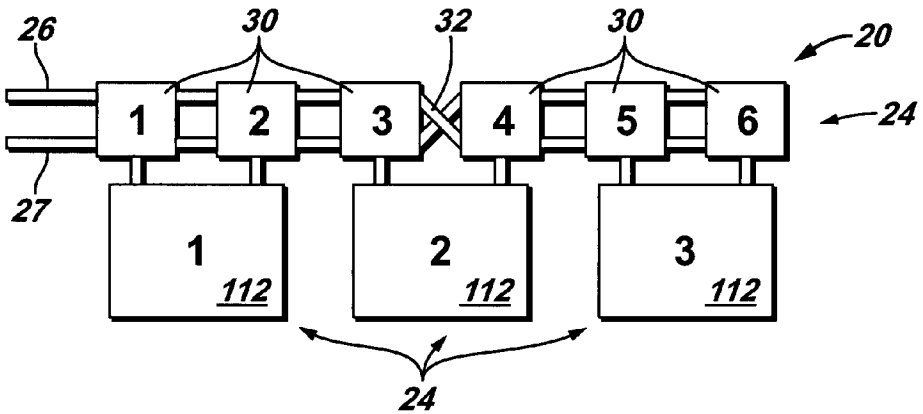
FIG. 12 is schematic view of another alternate embodiment of the present invention.

System 20 also is capable of being arranged in a variety of other configurations. For example, some of the well tool devices 24 may be formed from dual line tools 112 that are each coupled to a pair of decoders 30, as illustrated in FIG. 12. In this example, two control lines 26 and 27 are used to control three dual line tools 112 via six decoders and at least one crossover 32. In one application, a relief valve or valves (not shown) is referenced to the annulus or tubing to vent fluid from one of the dual lines coupled to the dual line tools 112 to the annulus or tubing. Accordingly, the control lines can be used to control individual tools or separate tool components within a given tool.

Figure 13:
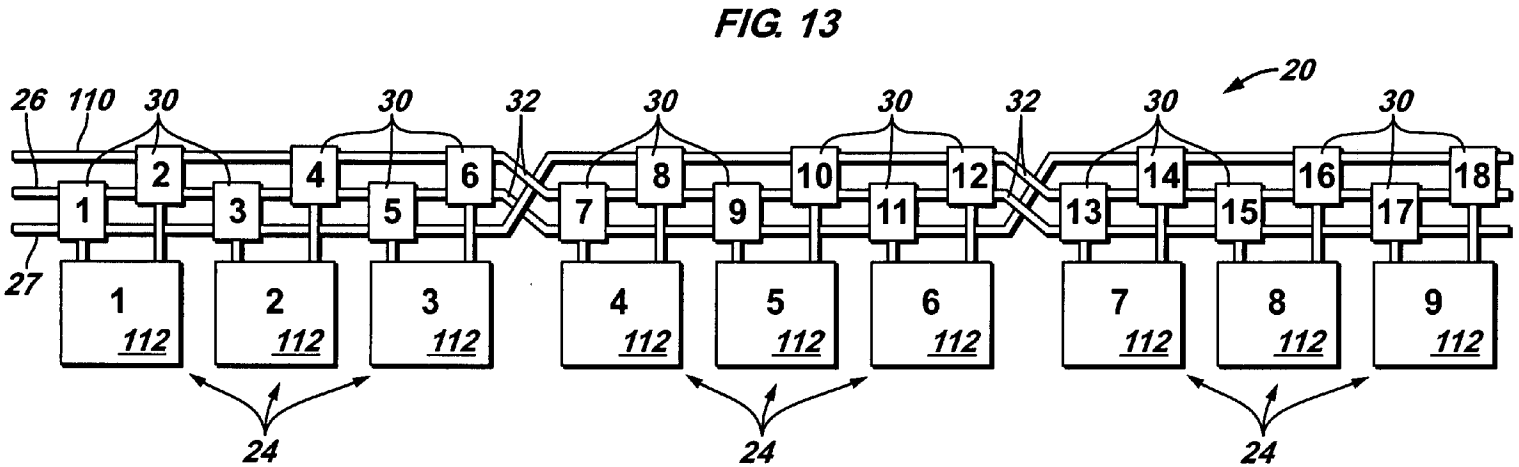
FIG. 13 is a schematic view of another alternate embodiment of the present invention.

In another embodiment, illustrated in FIG. 13, system 20 utilizes up to nine dual line tools 112 that are independently controlled with three control lines 26, 27 and 110. Again, two decoders 30 are coupled to each dual line tool 112 and appropriate crossovers are added to control independent actuation of specific tools based on pressure levels applied within at least one of the control lines. In this embodiment, the two decoders 30 attached to each individual tool 24 are matched with identical actuation pressures. The pilot ports of each pair of decoders are attached to the same control line. The command ports of each pair of decoders are attached to two different unique control lines. For example, with reference to the pair of decoders attached to the leftmost tool, the pilot port is connected to control line 26, and the command ports are attached to control lines 27 and 110, respectively.

Figure 14:
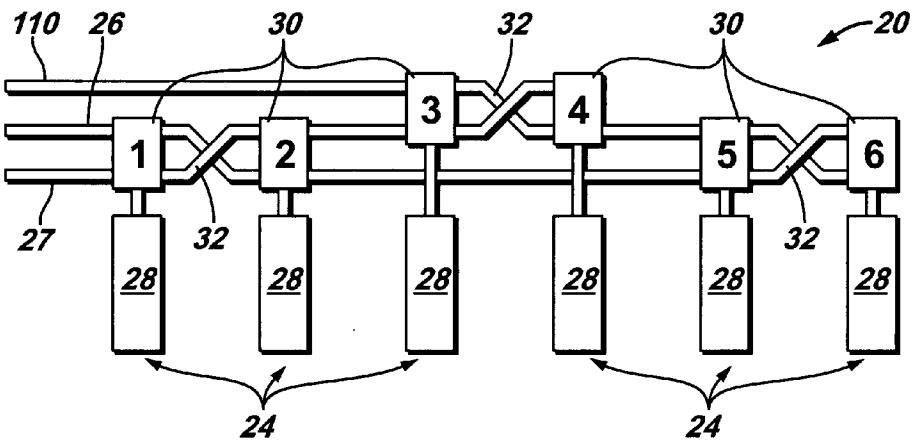
FIG. 14 illustrates another embodiment of the present invention utilizing three control lines.

In FIG. 14, an example of a single level pressure application is illustrated. In this embodiment, a single, unique pressure range can be used to independently control up to six tools 28 with three control lines 26, 27 and 110. As discussed above, because only a single pressure range is utilized, each decoder 30 can be formed with a single spring. In the specific example illustrated, the first or leftmost decoder 30 utilizes control line 26 as the pilot line and control line 27 as the command line. A crossover 32 is disposed between the first decoder 30 and the second decoder 30 such that control line 27 serves as the pilot line, and control line 26 serves as the command line. In the third decoder 30, control line 110 serves as the pilot line, and control line 27 serves as the command line. Another crossover 32 is disposed between the third decoder 30 and the fourth decoder 32 to enable use of control line 27 as the pilot line and control line 110 as the command line for the fourth decoder. In the fifth decoder 30, control line 26 serves as the command line, and control line 110 serves as the pilot line. Another crossover 32 is disposed between the fifth decoder 30 and the sixth decoder 30 and is coupled to control lines 26 and 110. This third crossover 32 enables the use of control line 26 as the pilot line and control line 110 as the command line. Thus, by utilizing three control lines and three crossovers 32 with appropriate valving as described above, a single pressure level can be used to independently control up to six well tools by applying the unique, predetermined pressure level to the appropriate control line.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for providing integrated control of multiple well tools, comprising:

at least three hydraulically controlled well tool devices; and a pair of hydraulic control lines coupled to the at least three hydraulically controlled well tool devices, wherein each of the at least three hydraulically controlled well tool devices is controllable independently of actuation of the other of the at least three hydraulically controlled well tool devices via application of unique pressure ranges through individual control lines of the pair of hydraulic control lines, wherein each hydraulically controlled well tool device comprises a decoder hydraulically coupled to a corresponding hydraulically controlled well tool, each decoder comprising a main valve that remains open through a predetermined unique pressure range applied to one of the pair of control lines, the other of the pair of control lines being placed in direct hydraulic communication with the hydraulically controlled well tool when the main valve is open.

2. The system as recited in claim 1, wherein at least four decoders are connected to at least four hydraulically controlled well tools, and the opening of the main valve in 50 percent of the at least four decoders is controlled by a first of the pair of control lines and the opening of the main valve in the other 50 percent of the at least four decoders is controlled by a second of the pair of control lines.

3. The system as recited in claim 1, wherein the unique pressure ranges comprise three unique pressure levels.

4. The system as recited in claim 1, wherein the at least three hydraulically controlled well tool devices comprise six hydraulically controlled well tool devices.

5. The system as recited in claim 4, wherein a first group of three hydraulically controlled well tool devices are controlled by unique pressure ranges in a first hydraulic control line of the pair of hydraulic control lines, and a second group of three hydraulically controlled well tool devices are controlled by unique pressure ranges in a second hydraulic control line of the pair of hydraulic control lines.

6. The system as recited in claim 1, wherein the predetermined pressure range is unique to each decoder controlled by a given hydraulic control line of the pair of hydraulic control lines.

7. The system as recited in claim 6, wherein the predetermined pressure ranges are established by a plurality of unique springs.

8. A system for providing integrated control of multiple well tools, comprising:

at least three hydraulically controlled well tool devices; and a pair of hydraulic control lines coupled to the at least three hydraulically controlled well tool devices, wherein the at least three hydraulically controlled well tool devices are independently controllable via application of at least one unique pressure level in at least one of the pair of hydraulic control lines, wherein each hydraulically controlled well tool device comprises a decoder hydraulically coupled to a corresponding hydraulically controlled well tool, each decoder comprising a main valve that remains open through a predetermined pressure range applied to one of the pair of control lines, the other of the pair of control lines being placed in direct hydraulic communication with the hydraulically controlled well tool when the main valve is open, wherein a plurality of the decoders each comprises an accumulator and an accumulator valve to establish a reference pressure with respect to the main valve.

9. A system for providing integrated control of multiple well tools, comprising:

at least three hydraulically controlled well tool devices; and a pair of hydraulic control lines coupled to the at least three hydraulically controlled well tool devices, wherein the at least three hydraulically controlled well tool devices are independently controllable via application of at least one unique pressure level in at least one of the pair of hydraulic control lines, wherein each hydraulically controlled well tool device comprises a decoder hydraulically coupled to a corresponding hydraulically controlled well tool, each decoder comprising a main valve that remains open through a predetermined pressure range applied to one of the pair of control lines, the other of the pair of control lines being placed in direct hydraulic communication with the hydraulically controlled well tool when the main valve is open, wherein a plurality of the decoders each comprises a filling valve disposed in parallel to the main valve to equalize any atmospheric pressure trapped in the corresponding hydraulically controlled well tool.

10. A method of controlling downhole tools, comprising:

connecting at least three downhole tools to at least three corresponding main valves that enable selective fluid flow to the at least three downhole tools;

using a pair of hydraulic lines coupled to the at least three corresponding main valves to selectively open any of the at least three corresponding main valves and to provide hydraulic input selectively to the at least three downhole tools upon opening of the corresponding main valve; and independently controlling the at least three corresponding main valves by applying pressure at a plurality of unique pressure ranges via an individual hydraulic line of the pair of hydraulic lines, the number of corresponding main valves independently controlled being greater than the number of unique pressure ranges.

11. The method as recited in claim 10, wherein applying pressure comprises applying pressure at two unique pressure ranges in a first hydraulic line of the pair of hydraulic lines.

12. The system as recited in claim 10, wherein applying pressure comprises applying pressure at three unique pressure ranges in a first hydraulic line of the pair of hydraulic lines this.

13. The method as recited in claim 12, further comprising locating each corresponding main valve in a decoder in which a biasing device is used to bias the valve against the pressure applied by the first hydraulic line.

14. The method as recited in claim 13, further comprising deploying an accumulator in each decoder to create a reference pressure acting against the main valve.

15. The method as recited in claim 12, further comprising:

coupling additional downhole tools to additional corresponding main valves;

selectively opening the additional corresponding main valves via the second hydraulic line; and providing hydraulic input to the additional downhole tools through the first hydraulic line.

16. The method as recited in claim 15, further comprising locating all of the additional corresponding main valves downstream from the at least three corresponding main valves along the first and the second hydraulic control lines.

17. The method as recited in claim 15, further comprising locating the additional corresponding main valves in an alternating arrangement with the at least three corresponding main valves along the first and the second hydraulic control lines.

18. A system of controllable well tools, comprising:

a plurality of downhole well tool components; and a plurality of fluid control lines, the number of downhole well tool components being at least one more than the number of fluid control lines, wherein any of the downhole well tool components may be selected and individually controlled by application of a unique pressure level selected from a plurality of unique pressure levels associated with corresponding downhole well tool components, wherein at least one of the fluid control lines acts individually to control actuation of more than one downhole well tool component of the plurality of downhole well tool components.

19. The system as recited in claim 18, wherein the plurality of fluid control lines comprises two control lines, and the plurality of downhole well tool components comprises at least four downhole tools.

20. The system as recited in claim 18, wherein the plurality of fluid control lines comprises three control lines, and the plurality of downhole well tool components comprises up to eighteen downhole tools.

21. The system as recited in claim 18, wherein each downhole well tool component comprises a decoder having a spring-loaded valve that is hydraulically actuated, the spring-loaded valve being designed to close if the pressure acting thereon moves above or below a given pressure range.

22. The system as recited in claim 21, wherein a single decoder is associated with a single hydraulically controlled well tool component of the plurality of downhole well tool components.

23. The system as recited in claim 21, wherein a pair of decoders is associated with a single hydraulically controlled well tool having at least two downhole well tool components independently controlled.

24. The system as recited in claim 21, wherein each decoder comprises an accumulator to establish a back reference pressure against the spring-loaded valve.

25. The system as recited in claim 21, wherein each decoder comprises a filling valve to equalize internal and external pressures.

26. The system as recited in claim 21, wherein the plurality of control lines comprises a pair of control lines that crossover between a pair of decoders.

27. The system as recited in claim 21, wherein the plurality of control lines comprises a pair of control lines that crossover between each decoder.

28. A system for controlling downhole tools, comprising:

means for providing selective fluid flow via a fluid command line to at least three fluid actuated downhole tools; and means for controlling independent actuation of each downhole tool by pressurizing an individual fluid pilot line to one of a plurality of unique predetermined pressure ranges, each unique predetermined pressure range being associated with the actuation of a specific downhole tool.

29. The system as recited in claim 28, wherein the means for providing comprises a main valve.

30. The system as recited in claim 29, wherein the means for controlling comprises a first spring and a second spring position to resist movement of the valve, the second spring being capable of exerting a greater spring force than the first spring.

31. A system for providing integrated control of multiple well tool components, comprising:

a plurality of decoders coupled to a plurality of well tool components;

a first control line coupled to the plurality of decoders;

a second control line coupled to the plurality of decoders, wherein the first and the second control lines each serve as a pilot line and a command line; and a crossover disposed between two decoders of the plurality of decoders, wherein the crossover changes the first control line from a pilot line to a command line for at least one subsequent well tool component.

32. The system as recited in claim 31, further comprising a plurality of crossovers disposed between the plurality of decoders.

33. The system as recited in claim 31, wherein the plurality of decoders comprises at least four decoders.

34. The system as recited in claim 31, further comprising a third control line that serves as the pilot line and the command line.

* * * * *